United States Patent [19]

Harmer

[11] 3,946,232

[45] Mar. 23, 1976

[54] PYROELECTRIC CAMERA TUBES

[75] Inventor: Alan Lewis Harmer, Chelmsford, England

[73] Assignee: English Electric Valve Company Limited, Chelmsford, England

[22] Filed: Oct. 25, 1974

[21] Appl. No.: 518,167

[30] Foreign Application Priority Data

Oct. 29, 1973 United Kingdom ..... 50154/73

[52] U.S. Cl. ..... 250/333; 250/330; 315/10

[51] Int. Cl.[2] ..... H01J 31/49

[58] Field of Search ..... 250/330, 332, 333; 315/10

[56] References Cited

UNITED STATES PATENTS 3,774,043 11/1973 Carvennec ..... 250/330

3,812,396 5/1974 Crowell ..... 250/332

*Primary Examiner*—Archie R. Borchelt

*Attorney, Agent, or Firm*—Baldwin, Wight & Brown

[57] ABSTRACT

A pyroelectric camera tube having a high resistivity target is operated by applying an increasing ramp voltage to the target so as to provide a pedestal potential which permits objects producing a negative change in temperature to be viewed and then pulsing the target to neutralise the resultant electric field established between the signal and electron beam scanned surfaces of the target. Thus during the rising ramp voltage the tube operates in a cathode potential stabilised mode and at the end of the ramp the target is pulsed to operate the tube in an anode potential stabilised mode. Since the pedestal voltage is provided by the ramp voltage the tube may be substantially evacuated.

18 Claims, 8 Drawing Figures

PYROELECTRIC CAMERA TUBES

Figure 1:
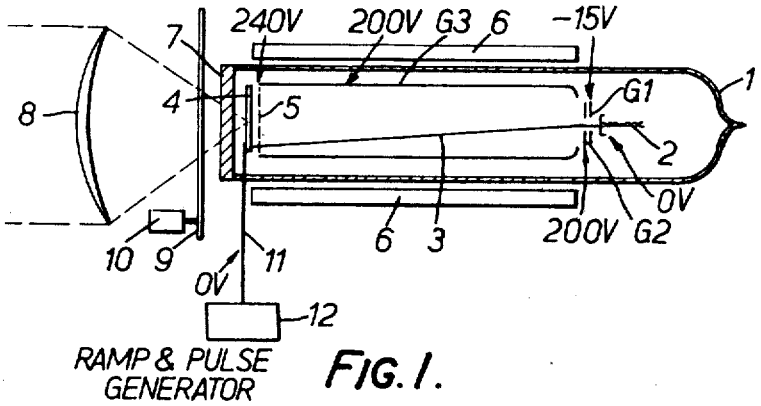

This invention relates to pyroelectric camera tubes.

It is known that a pyroelectric camera tube has a target electrode that is sensitive to temperature changes of viewed optical scenes and such targets may be formed from, for example, triglycine sulphate. The target may be considered as a plurality of elemental capacitors which are charged in dependence upon the change in temperature of the viewed optical scene projected onto the front surface of the target and which elemental capacitors are discharged to a predetermined reference potential by an electron beam which scans the rear surface of the target. The resulting elemental capacitor discharging current is taken from a signal plate on the front surface of the target and fed to a video amplifier for utilization in the customary fashion. For satisfactory tube operation, so that the beam lands on the target orthogonally, a mesh electrode is disposed a small distance from the rear surface of the target.

Before the target can be used it must be "poled" either "black-moving," in which condition hot viewed objects appear black, or "white-moving," in which condition hot objects appear white. The target, which comprises a plurality of internal electric dipoles, is poled black-moving by applying an electric field between the front and rear surfaces thereof such that the front surface is raised positively with respect to the rear surface; a converse polarity of electric field is applied to pole the target white-moving.

Normally pyroelectric camera tubes are operated in one of two modes, of which the first mode is known as "anode potential stabilized" (APS). In this mode the tube is operated with the target at substantially the same potential as the mesh (approximately 240v) and with the electrons in the scanning electron beam generating secondary electrons at the target and mesh. A "dynamic" balance is set up at the target between primary electrons arriving, secondary electrons leaving the target and secondary electrons from the mesh which arrive at the target.

The second mode of operation is known as "cathode potential stabilized" (CPS) in which mode the electron beam side of the target is maintained at near the electron beam producing cathode potential and the target is stabilized due to being driven negatively towards the cathode potential by the electron beam until no more electrons are able to land thereon. This mode tends to suffer from the defect that only objects producing a positively charged image on the target can be read. Thus, to take as an example a target that is poled white-moving, objects thermally greater than romm temperature will produce a positive charge on the target resulting in a white image, but on removal of the hot object the target falls below cathode potential, and objects producing a negative change iin temperature also produce a negative charge on the target, that cannot be discharged by the scanning electron beam and so cannot be viewed.

A known method for reducing the forementioned disadvantage of the CPS mode of operation when the target has a high resistivity (greater than $10^{11}$ Ω cm) is to fill the tube volume at the rear of the target with a gas, usually of hydrogen or helium, which is ionised by the electron beam to produce a small positive "pedestal" potential on the target (typically 0.05v). Thus, viewed objects which produce a negative change in temperature of the target now provide a small decrease in the positive charge on the target due to the pedestal potential which can be discharged to produce a signal output and resulting optical image. It is of course desirable to increase the pedestal potential since, as will be shown later, the output efficiency of the tube may be increased but a serious practical defect arises that it is not readily possible to introduce a sufficiently greater quantity of gas into the tube so as to effect this measure. Furthermore, the gas tends not to be evenly distributed over the target surface resulting in picture distortion and uneven shading. Also, because of impurities that are introduced with the gas the operating life of the tube is lessened due to the impurities collecting on the tube electrodes and ion bombardment of the cathode caused by the gas being ionised by the electron beam.

One object of the present invention is to provide a method of operating a pyroelectric camera tube which is able to produce output signals whilst operating in the CPS mode but in which the forementioned defects of CPS mode operation are at least substantially reduced.

According to this invention in its broadest aspect a method of operating a pyroelectric camera tube having a high resistivity target and means for producing an electron beam includes the steps of applying to the target for a predetermined time an increasing ramp voltage which is capable of providing a pedestal voltage, and then substantially neutralising the resultant electric field established between the signal and electron beam scanned surfaces of the target.

According to a feature of this invention a method of operating a pyroelectric camera tube having a high resistivity target and means for producing an electron beam includes the steps of applying to the target for a predetermined time an increasing ramp voltage which is capable of providing a pedestal voltage of substantially the same magnitude as the energy spread in the electron beam, and then substantially neutralising the resultant electric field established between the signal and electron beam scanned surfaces of the target.

Preferably the increasing voltage is a linearly rising ramp voltage.

During the period of the linearly rising ramp voltage the tube is connected such that it is capable of operating in the CPS mode and at the termination of the ramp voltage the target is pulsed to operate the tube in the APS mode prior to returning to CPS mode operation before the restart of the ramp voltage.

Preferably at the termination of the ramp voltage and only during APS mode operation the electron beam intensity is increased so that the electric field is rapidly neutralised.

Advantageously after the completion of the APS mode of operation, but before restarting the ramp voltage, when the target is again operating in the CPS mode, the electron beam intensity is again increased to substantially neutralise positive charge occuring on the electron beam side of the target.

During operation in the APS mode preferably either one of the tube anodes is pulsed by a sufficient potential to defocus the electron beam.

A circuit arrangement includes a pyroelectric camera tube having a high resistivity target and which is substantially evacuated of gas, means for generating an increasing ramp voltage so as to provide a pedestal voltage of substantially the same order of magnitude as the energy spread in the electron beam, and means for substantially neutralising the electric field produced by the ramp voltage between the signal and electron beam scanned surfaces of the target.

A pyroelectric camera tube for operating in accordance with this invention includes means for producing a scanning electron beam, a high resistivity target and means for projecting onto the target a thermal image, wherein the tube is substantially evacuated of gas.

Preferably the tube is pumped to a pressure of $10^{-6}$ torr.

Figure 2:
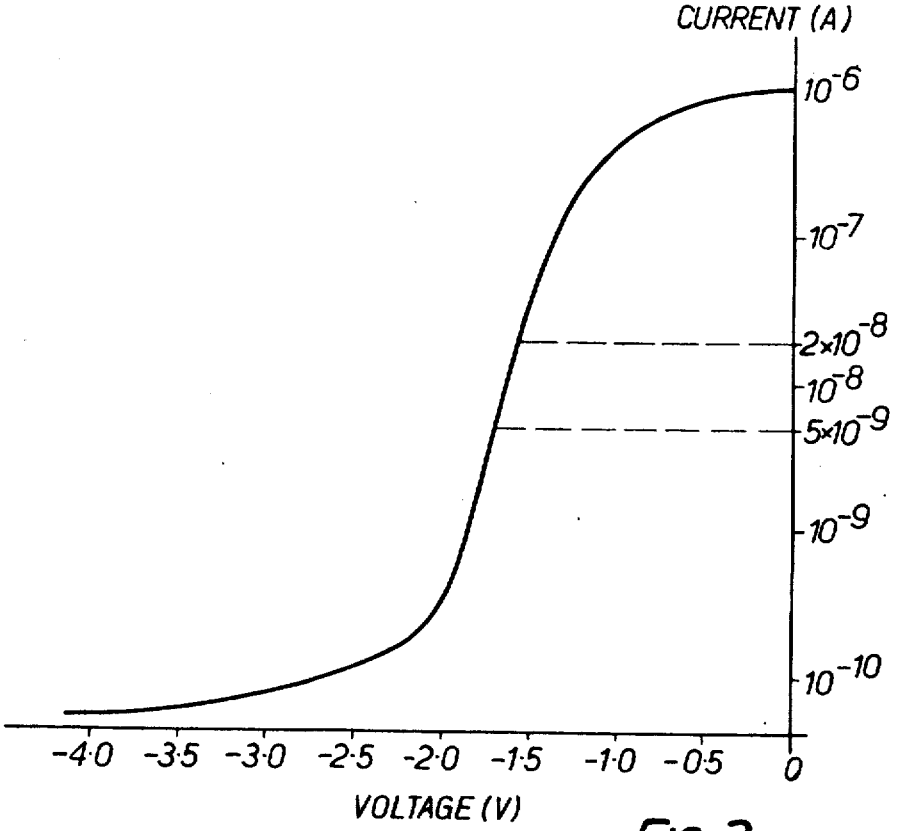
Figure 3:
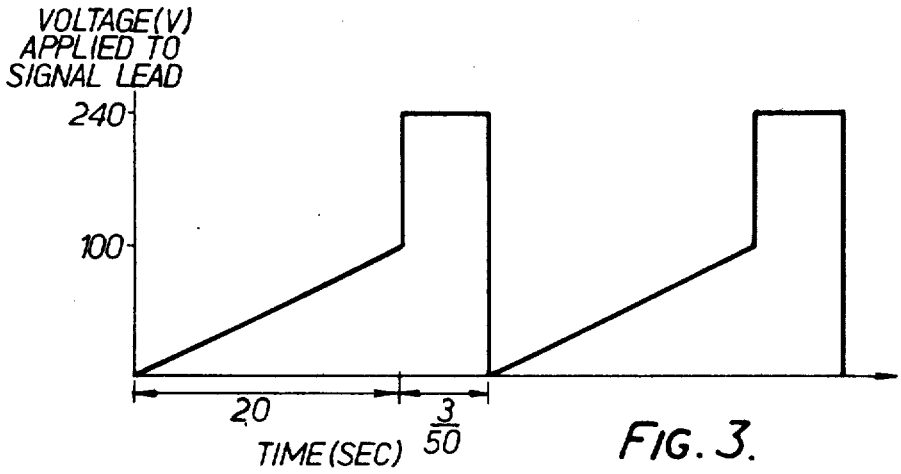
Figure 4:
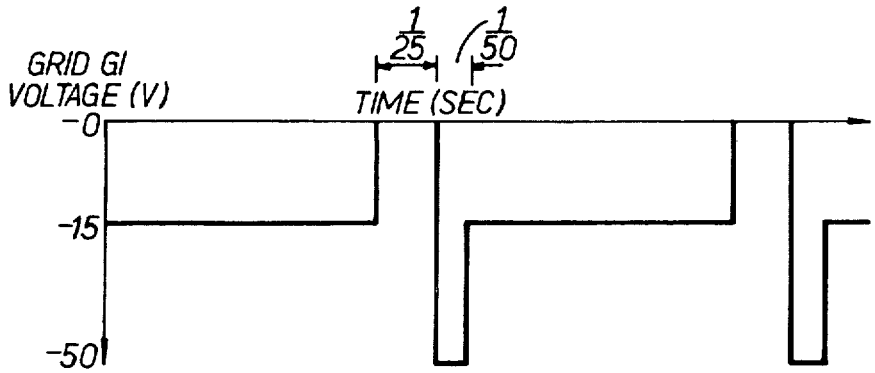
Figure 5:
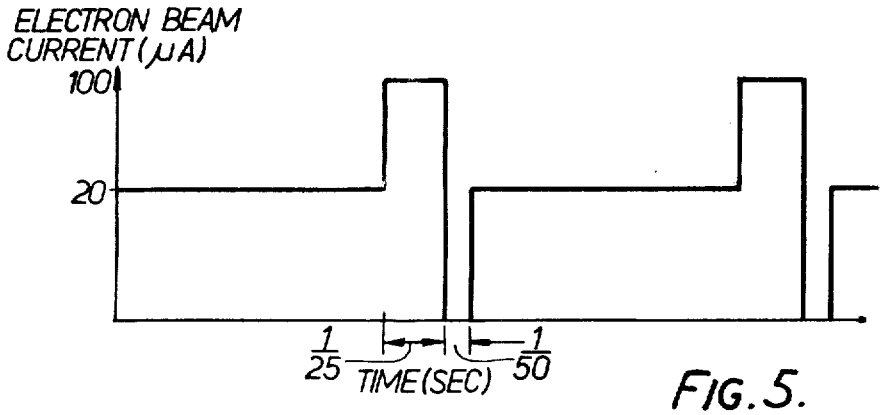
Figure 6:
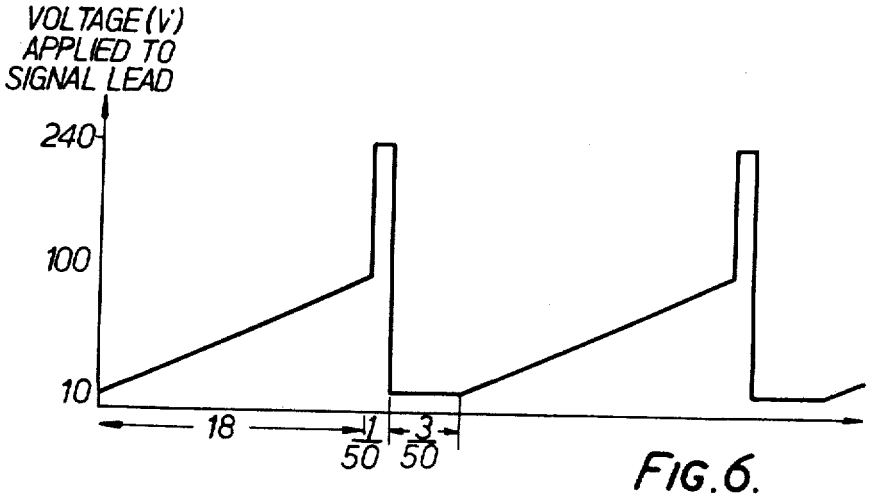
Figure 7:
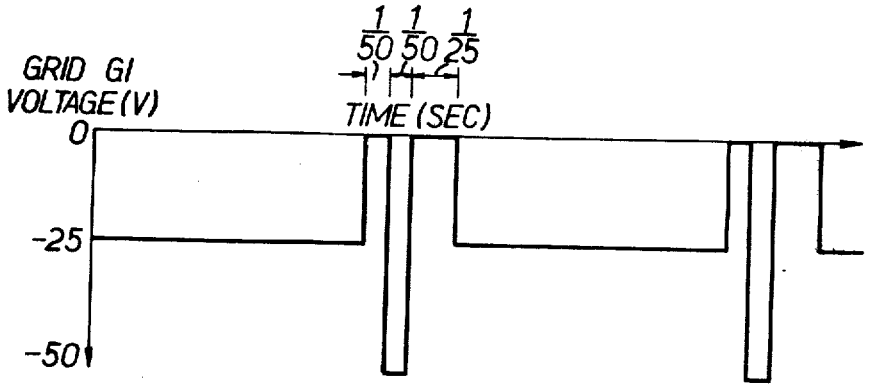
Figure 8:
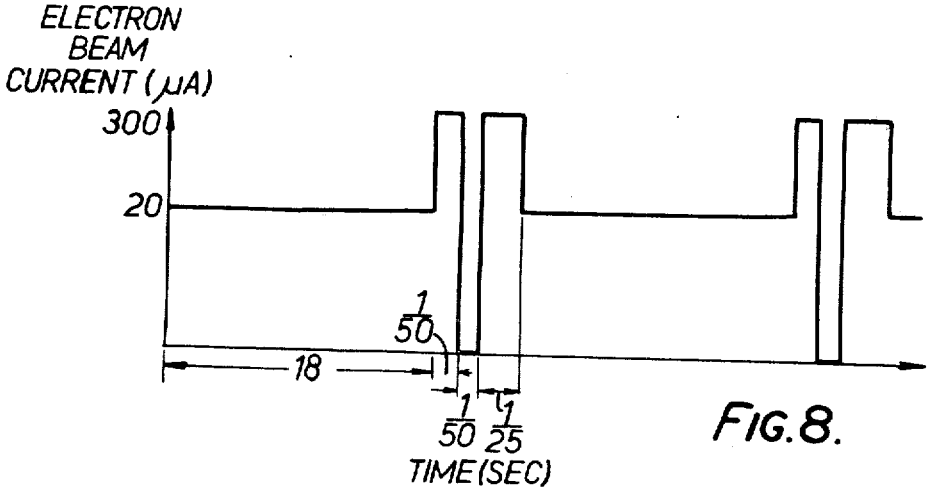

The invention will now be described, by way of example, with reference to the accompanying drawings, in which, FIG. 1 shows a schematic diagram of a pyroelectric camera tube for use in accordance with this invention, FIG. 2 shows a target electron beam-landing characteristics, and FIGS. 3, 4 and 5 show in diagrammatic manner timing waveforms applied to the signal plate and the control grid respectively, and the electron gun beam current resulting from variation of the control grid voltage for the tube shown in FIG. 1 to operate in accordance with this invention, and FIGS. 6, 7 and 8 show alternative diagrammatic waveforms applied to the signal plate and the control grid respectively, and the resultant electron beam current for the tube shown in FIG. 1.

The pyroelectric camera tube shown in FIGS. 1 includes within a sealed envelope 1, a cathode 2 for producing an electron beam 3 which is directed towards a triglycine sulphate target 4 and mesh 5 by a control grid G1, a first anode G2 and a wall anode G3. The electron beam 3 is scanned over the rear of the target 4 surface by focusing and scanning coils 6 and signals produced by the discharge of target elemental capacitors (not shown) are transferred for utilization over signal lead 11. Positioned in front of the target 4 and forming a closure for the tube is a germanium window 7 which transmits thermal energy to the target 4. Prior to the thermal energy reaching the target 4 it is focused thereon by a germanium lens 8 which is positioned in front of the window 7 and so that thermal charges are produced on the target 4 a shutter 9 driven by a motor 10 is placed between the window 7 and the lens 8. The operating voltages shown in FIG. 1 are fed to the appropriate electrodes from a camera unit only part of which, the ramp and pulse generator 12, being shown for clarity.

As so far described the tube is conventional but unlike known tubes having a high resistivity target (greater than $10^{11}$ Ω cm), for operation in the CPS mode, the present tube is pumped to a low pressure of the order of $10^{-6}$ torr. Further unlike conventional pyroelectric tubes the normally provided conducting ring is eliminated since it has been found that this ring produces a bright annulus in a resultant picture.

Referring to FIG. 2, a typical target electron beam landing characteristic is shown having a voltage abscissa and logarithmic scale ordinates of current. The abscissa axis is representative of the amount the target 4 is driven negative by the landing electron beam and also indicative of the spread of the electron beam energy striking the target, and the ordinate axis shows the corresponding target signal lead 11 output current.

Suppose the target is not provided with a pedestal voltage, then the target is driven a few volts negative thereby producing a signal output in the picoampere range. It will be seen from this characteristic that a typically 0.05v pedestal voltage provided in known camera tubes by the positively charged gas produces an output signal in which the working level of the target is $5 \times 10^{-9}$A. The present invention provides a pedestal voltage of substantially the same order of magnitude as the energy spread in the electron beam (typically 0.2v) thereby increasing the working level of the target to $2 \times 10^{-8}$A.

The pedestal voltage is achieved, in operation, from the linearly rising ramp voltage generator 12 connected to the signal lead 11, the timing waveform of this generator being shown in FIG. 3. It is required that the 0.2v pedestal voltage is achieved in one frame (1/25 sec.) so that the ramp rate is 5v/sec. and the ramp is allowed to rise for 20 sec. It will be realised by those skilled in the art that the ramp rate may be increased to increase even further the target output current.

During the period of the rising ramp voltage the electron beam current (shown in FIG. 5) is substantially constant at 20 μA, the grid G1 is at a normal operating level of −15v (as shown in FIG. 4), and the tube is thus operated in the CPS mode. At the end of the 20 sec. period the signal side (front) surface of the target is at 100v and the scanned (rear) surface of the target is at 0v so that an electric field is produced between the front and rear surfaces of the target. It will be remembered that the target 4 may be considered as a plurality of elemental capacitors and so as to neutralise the electric field, i.e., discharge the elemental capacitors, the voltage on the signal lead 11 is pulsed to 240v by the generator 12 thereby switching the tube into the APS mode. Thus, secondary electrons liberated by the target rapidly raise the potential of the electron beam scanned side of the target to that of the signal side (240v). At substantially the same instant of time grid G1 is pulsed to 0v so that the electron beam current is increased to 100 μA thereby decreasing the time taken to neutralise the electric field. After a time duration equivalent to two fields (1/25 sec.) the elemental capacitors are substantially discharged and the grid G1 is pulsed to −50v and the electron beam turned off for one field (1/50 sec.). During this latter period the signal lead potential is brought back to 0v prior to re-starting the ramp voltage generator and the cycle of operation repeating.

An alternative manner of operating the tube shown in FIG. 1 is shown schematically by the waveforms of FIGS. 6, 7 and 8. From FIG. 6 it will be seen that the ramp voltage now starts at 10v, instead of 0v as shown in FIG. 3, so as substantially to reduce potential variation across the target 4 produced whilst operating in the APS mode. Since the ramp rate has been maintained at 5v/sec the ramp duration is reduced to 18 sec after which time the signal lead 11 is pulsed to 240v to switch the tube into APS mode operation.

At substantially the same instant of time grid G1 is pulsed from −25v to 0v (see FIG. 7) so that the electron beam current is increased to 300 μA thereby decreasing the time taken to neutralise the electric field. After a time duration equivalent to one field (1/50 sec.) the elemental capacitors are substantially discharged and the grid G1 is pulsed to −50v and the electron beam turned off for one field (1/50 sec.).

During this latter period the signal lead potential is brought back to 10v. The electron beam current (FIG. 8) is then increased to 300 μA by pulsing control grid $G_1$ to 0v for the duration of the next two fields (1/25 sec.) to neutralise any positive charge which may occur on the electron beam side of the target and to ensure that the whole surface of the electron beam side of the target 4 is at cathode potential when the ramp is restarted. The cycle of operation is then repeated.

When the tube is switched into the APS mode by pulsing the target to 240v a non-uniform charge distribution on the beam side of the target may be produced due to redistribution of electrons across the target during the APS mode period of operation or inhomogeneities in the secondary electron emission coefficient of the target material. To reduce this effect a voltage pulse may be applied to either $G_2$ or $G_3$ (to alter their electrode voltage by 100v) to defocus the beam during the APS period.

Because the beam current and pedestal voltage are independent of one another the pedestal level may be raised instantaneously without altering the beam current. For example, if the tube is operated black moving a hot thermal overload will push the target potential below cathode potential and the signal will be clipped to the level of the ramp pedestal voltage. However, the pedestal voltage may be increased momentarily during hot signal overloads to read off the charge completely, by increasing the ramp rate.

I claim:

1. The method of operating a pyroelectric camera tube having a high resistivity target presenting a front face from which video signal are read off, a rear face adapted to be scanned by an electron beam, and cathode means for producing the electron beam, which comprises the steps of:

a. operating the pyroelectric camera tube under conditions which establish cathode potential stabilized mode of operation thereof;

b. during step (a), applying an increasing ramp voltage to the front face of the target of the pyroelectric camera tube while scanning the rear face of the target with the electron beam, and controlling the rate of increase of the ramp voltage with respect to the energy spread of the scanning electron beam so as to produce a pedestal voltage during the cathode potential stabilized mode of operation;

c. terminating the increasing ramp voltage at a selected potential and pulsing the front face of the target in a positive direction relative to the cathode to operate the tube in anode potential stabilized mode until the potential of the rear face of the target is raised to said selected potential; and then d. pulsing the front face of the target negatively with respect to the cathode so that the tube is returned to cathode potential stabilized mode.

2. The method according to claim 1 wherein said pedestal voltage is in the order of 0.02 volts.

3. The method according to claim 2 wherein said ramp voltage is linearly increased.

4. The method according to claim 3 including the step of increasing the intensity of the electron beam during step (c).

5. The method according to claim 1 wherein said ramp voltage is linearly increased.

6. The method according to claim 1 including the step of increasing the intensity of the electron beam during step (c).

7. The method according to claim 6 wherein said pedestal voltage is in the order of 0.2 volts.

8. The method according to claim 7 wherein said ramp voltage is linearly increased.

9. The method according to claim 6 wherein said ramp voltage is linearly increased.

10. A circuit arrangement including a pyroelectric camera tube having a high resistivity target providing an electrically conductive front face adapted to receive a thermal image and a rear face adapted to be scanned by an electron beam, cathode means for scanning said rear face with an electron beam, an enclosing envelope which is evacuated, and means for normally operating said tube in cathode potential stabilized mode; and ramp generator means connected to said front face for periodically producing an increasing ramp potential thereon in which the potential increases at a rate related to said scanning electron beam to produce a selected pedestal voltage, for pulsing said front face positively with respect to said cathode means when said ramp potential reaches a selected value so as to operate said tube in anode potential stabilized mode until the potential of said rear face reaches said selected value, and for thereafter pulsing said front face negatively with respect to said cathode means so that the tube is returned to cathode potential stabilized mode.

11. A circuit arrangement as defined in claim 10 wherein said envelope is evacuated to a pressure of $10^{-6}$ torr.

12. A circuit arrangement as defined in claim 10 wherein said cathode means includes a control grid for controlling the intensity of said electron beam, and including means for pulsing said control grid to increase the intensity of said electron beam when the tube is operating in anode potential stabilized mode.

13. A circuit arrangement as defined in claim 10 wherein said ramp voltage increases linearly.

14. A circuit arrangement as defined in claim 12 wherein said envelope is evacuated to a pressure of $10^{-6}$ torr.

15. A circuit arrangement as defined in claim 14 wherein said ramp voltage increases linearly.

16. A method as recited in claim 1 including after step (d) the additional step of increasing the intensity of the electron beam so as substantially to neutralize the positive charge occurring on the rear face of the target.

17. A method as recited in claim 1 wherein said pyroelectric camera tube is provided with a pair of additional anodes for guiding said electron beam to said target, said method including during step (d) the additional step of applying a voltage pulse to at least one of said additional anodes so as to defocus said electron beam.

18. The method of producing a pedestal voltage in a pyroelectric camera tube having a high resistivity target presenting a front face from which video signals are read off, a rear face adapted to be scanned by an electron beam, and cathode means for producing the electron beam, which comprises the steps of:

a. operating the pyroelectric camera tube under conditions which establish cathode potential stabilized mode of operation thereof; and b. during step (a), applying an increasing ramp voltage to the front face of the target of the pyroelectric camera tube while scanning the rear face of the target with the electron beam, and controlling the rate of increase of the ramp voltage with respect to the energy spread of the scanning electron beam so as to produce a pedestal voltage during the cathode potential stabilized mode of operation.

* * * * *